United States Patent [19]

Rickard

[11] 4,252,100

[45] Feb. 24, 1981

[54] ARCHERY BOW WITH MOVABLE HANDLE

[76] Inventor: Lawrence C. Rickard, 580 Mentone Rd., Lantana, Fla. 33462

[21] Appl. No.: 924,635

[22] Filed: Jul. 14, 1978

[51] Int. Cl.[2] ..... F41B 5/00

[52] U.S. Cl. ..... 124/23 R; 124/88

[58] Field of Search ..... 124/88, 89, 86, 24 R, 124/23 R, 41 A

[56] References Cited

U.S. PATENT DOCUMENTS

| | | | |
|---|---|---|---|
| 2,854,965 | 10/1958 | Eberbach | 124/24 R X |
| 3,397,685 | 8/1968 | Walker | 124/24 R |
| 3,491,739 | 1/1970 | Scrobell | 124/23 |

*Primary Examiner*—William R. Browne

*Attorney, Agent, or Firm*—Malin & Haley

[57] ABSTRACT

A handle for use with an archery bow that allows the user to adjust the position of the holding hand which stabilizes the bow to an adjustable position relative to the bow itself. The bow frame includes a recessed portion (facing the bowstring) which receives the handle that is mounted on a rigid vertical shaft disposed within the recessed portion. The handle, body, which is shaped to comfortably accommodate the hand of the user, is spring biased about the shaft on a tapered annular ring allowing the handle body to be moved in two dimensions relative to the vertical shaft attached to the bow frame. A pair of sleeves are spring mounted longitudinally along the periphery of the shaft, the ends of which engage the tapered annular ring which allow for complete movement of the handle while still stabilizing it relative to the bow. The vertical shaft supporting the handle body is aligned with the bowstring.

2 Claims, 3 Drawing Figures

ARCHERY BOW WITH MOVABLE HANDLE

BACKGROUND OF THE INVENTION

This invention relates generally to an improved archery bow handle, and specifically to a handle which allows for movement of the handle relative to the bow frame for accommodating particular positioning of the hand and arm of the archer's relative to a bow frame without sacrificing accuracy or bow draw power.

One of the problems encounted by an archerer using a bow and arrow is that on many bows, the draw weight is often times a large force which has to be firmly supported by the strength in the arm of the archerer's. For example, for a right handed archerer's who pulls the bowstring back with his right hand, the left hand and arm must act as a brace pushing against the bow frame which must be stabilized to achieve accuracy prior to releasing the bowstring. Because of the positional relationship of the bowstring and the bow frame necessary for proper power and arrow accuracy, prior art bows have been uncomfortable while drawing and aiming. No accommodation is made for individuals of different sizes. Because each individual varies with respect to arm, wrist and hand sizes and the like, prior art bows having no grasping adjustment are often uncomfortable to draw and hold.

The present invention provides an improved archery bow that allows the user to adjust the bow frame with respect to grasping hand and arm to a position which may be more comfortable to the user without sacrificing accuracy or bow release force. Specifically, the handle is coupled to the bow frame in such a way as to allow relative movement with respect to the bow frame in two dimensions.

BRIEF DESCRIPTION OF THE INVENTION

An archery bow handle, which is affixed to an archery bow frame comprising an archery bow frame having a recessed portion on the bowstring side of the frame, a rigid shaft disposed vertically between the top and bottom of the recessed portion, the rigid shaft lying in the plane of the bowstring. The handle is moveably mounted on the shaft, the handle including a hollow, rigid shell shaped to be comfortably grasped by the user, the shaped shell including an upper area which is radially recessed to receive the area of the hand between the thumb and index finger, an annular, tapered support disposed within the handle shell, first, second and third rigid sleeves which fit over the vertical shaft and a spring mounted between the first and second sleeves to bias the annular support coupling between the second and third sleeves. The ends of the second and third sleeves are received and engage the tapered apex portion of the annular ring disposed within the handle shell.

Because of the biased coupling along the shaft provided by the first, second and third sleeves in conjunction with the spring, the tapered annular ring can be moved relative to the second and third sleeves such that the handle may be positioned in two dimensions relative to the vertical shaft within limitations provided by stops. Thus, the handle may be pivoted in a forward and backward direction and also rotated around the shaft, encompassing two dimensions. A pin is disposed and connected to the bow frame projecting into the upper portion of the handle shell such that rotation of the handle shell relative to the shaft will, at stopping points, engage the pin in either direction at the interior surface of the handle shell, providing a stop for the handle with regard to motion around the shaft. An opening at the base of the handle shell will engage the first sleeve to provide a stop for forward and backward pivotal motion of the handle.

To operate the device, the user grasps the handle with one hand while drawing the bowstring back with the other hand. The handle can thus be adjusted to accommodate a particular position desired by the user while the bow is being drawn, held and released. Since the vertical shaft supporting the handle shell is aligned and in the same plane as the bow draw string, the flight of the arrow will be accurate.

It is an object of this invention to provide an improved handle for grasping an archery bow.

It is another object of this invention to provide an improved archery bow handle which allows for positioning of the grasping hand relative to the bow housing at a desired position without deleteriously effecting the accuracy or draw strength of the bow.

And yet, another object of this invention is to provide an archery bow handle which may be adjusted in all three dimensions relative to the archery bow frame without affecting the accuracy of the archerer.

In accordance with these and other objects which will be apparent hereinafter, the instant invention will now be described with particular reference to the accompanying drawings.

PREFERRED EMBODIMENT OF THE INVENTION

Figure 1:
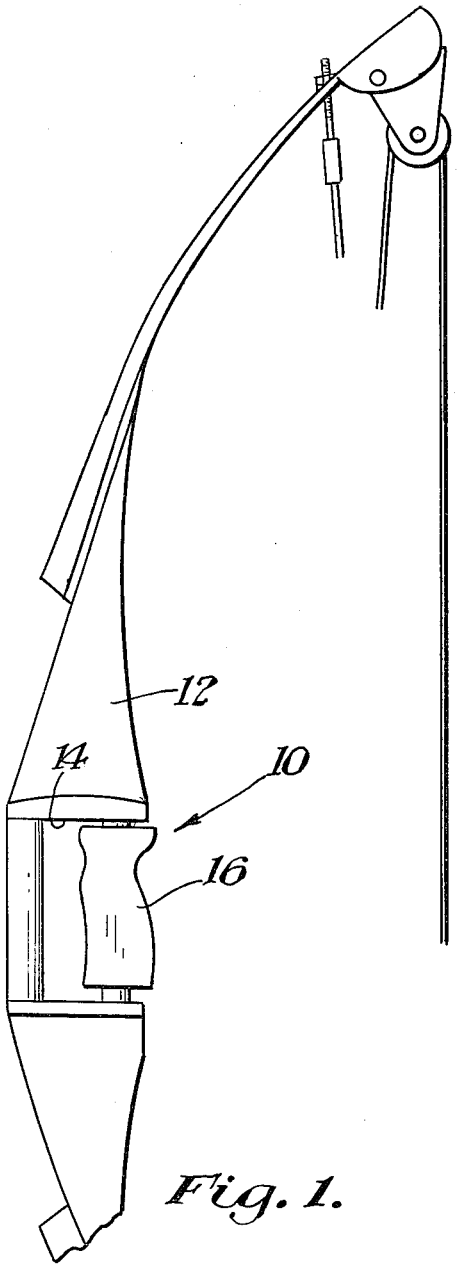
FIG. 1 shows a fragmentary view of an archery bow frame and bowstring showing applicant's improved handle mounted thereon.

Referring now to the drawings and specifically FIG. 1, the instant invention is shown generally at 10 which includes a handle shell 16 mounted on an archery bow frame 12 within a recessed portion 14 which is more fully described below.

Figure 2:
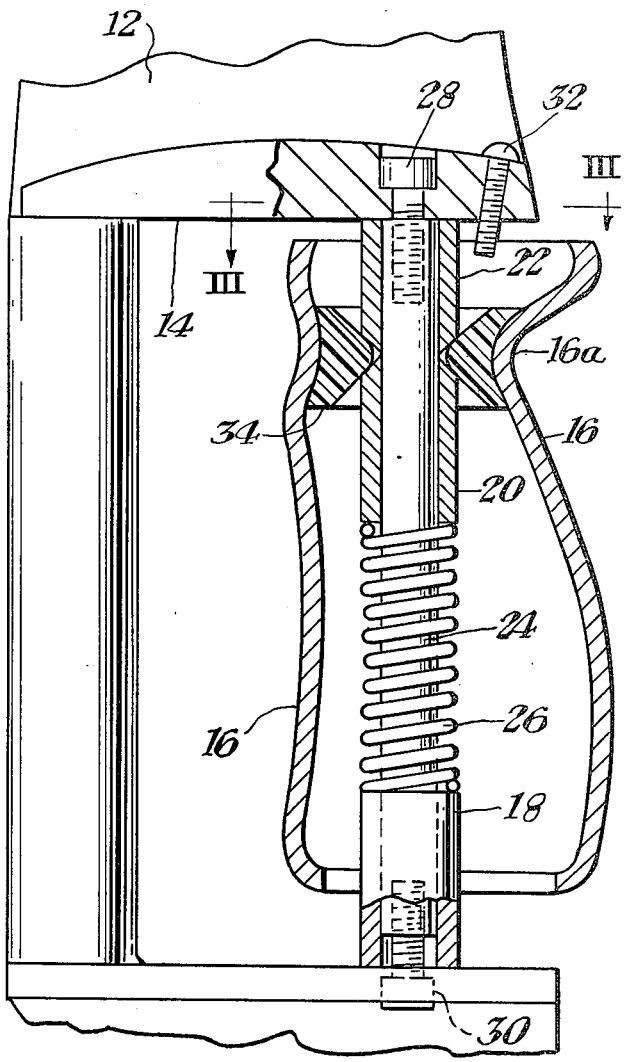
FIG. 2 shows a side elevational view partially in cross-section showing the instant invention.

Referring now to FIG. 2, the instant invention is shown with a contoured handle shell 16 which is essentially hollow and includes an contoured surface portion **16*a* which receives the area of the hand between the thumb and index finger which allows the entire handle shell to be grasped by the user's hand. The overall shape of the handle shell 16 is such to accommodate comfortably the archer's hand when aligning the frame 12 prior to releasing the arrow. The archery bow frame 12 has a recessed portion 14 which faces the bowstring (which in the illustration of FIG. 2 would be to the right of the recessed portion as shown). Disposed vertically within the recessed portion 14 of the archery bow housing is a vertical, rigid shaft 24 connected at each end by screws 28 and 30 to the bow housing. A first cylindrical rigid sleeve 18 is coupled near the bottom of shaft 24 and is connected by spring 26 to a second sleeve 20 which abuts spring 26 at one end and an annular ring 34, which is rigidly coupled inside the handle shell 16. A third sleeve 22 abuts the annular ring 34 at one end and the upper inside surface of recessed portion 14 of the archery bow body. The annular mounting ring 34 is tapered inwardly with the apex sitting between second sleeve 20 and third sleeve 22. A handle shell stop 32 is mounted and projects from the upper portion of the bow recessed portion 14 to limit the rotational position of the handle shell 16 which is rotatable about shaft 24**.

Figure 3:
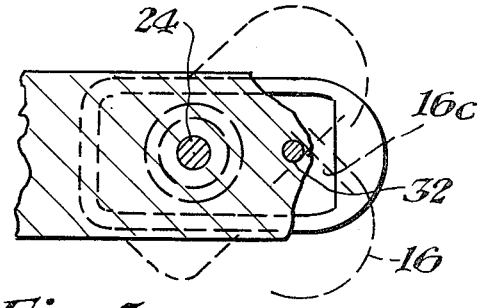
FIG. 3 shows a top plan view with different handle positions, dotted showing the instant invention.

FIG. 3 shows the limits of rotation of handle or handle shell 16 in its rotation around shaft 24 by pin 32 in that the pin engages the upper interior portion 16*c* of the handle 16.

The second sleeve 20 and third sleeve 22, which compress against the tapered walls of the annular ring 34 under the spring tension 26, thus allow relative movement between the annular ring 34 (and therefore handle 16) such that the handle may be moved in the vertical plane backwards and forwards and also allow rotation of the handle around the shaft. Thus, one grasping the handle is free to adjust the handle, both rotationally and in a vertical plane, either backward or forward until a desired grasping position is achieved. This can be done throughout the process of drawing the bow back, holding the bow just prior to release of the bowstring, and during release of the bowstring.

The vertical shaft 24 is aligned with the plane running through the bow frame and the drawstring such that the movement of the handle around the shaft will not affect the accuracy of the bow when released. The end surfaces of sleeves 20 and 22 that engage annular ring 34 may be themselves tapered to flushly fit against the wall surface of ring 34.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. In combination; an archery bow frame having an archery bow handle, said handle being coupled to said archery bow frame, and comprising:

said archery bow frame having a recessed portion facing a strung drawstring; said recessed portion having top and bottom surfaces;

a rigid shaft disposed between the top and bottom surfaces of the recessed portion;

said handle comprising a contoured handle shell;

a means for mounting said handle shell on said rigid shaft and said means being disposed within said handle shell; and a biasing means connected to said shaft and biasing said mounting means while allowing two dimensional movement, pivotal movement back and forth generally in the plane of the bow and bowstring, rotational movement about the vertical axis of the shaft, said biasing means permitting the shell to move up and down along the longitudinal axis of the shaft;

said mounting means including a first sleeve and a second sleeve, said first and second sleeves having ends being biased by said biasing means.

2. An archery bow as in claim 1, wherein: said mounting means includes a tapered annular ring disposed in said handle shell.

* * * * *